United States Patent [19]

Smith

[11] 4,244,760

[45] Jan. 13, 1981

[54] FIXING OF ENDS OF WOOD OR REINFORCED PLASTIC RUNGS INTO PULTRUDED FIBREGLASS REINFORCED PLASTIC EXTENSION LADDER STILES WITHOUT THE USE OF METAL

[76] Inventor: Francis C. Smith, 9 Glenview Rd., Strathmore, Victoria 3041, Australia

[21] Appl. No.: 69,591

[22] Filed: Aug. 24, 1979

Related U.S. Application Data

[63] Continuation of Ser. No. 911,900, Jun. 2, 1978, abandoned.

[30] Foreign Application Priority Data

Sep. 21, 1977 [AU] Australia ..... PD1759

[51] Int. Cl.[3] ..... E06C 7/08; E06C 7/10

[52] U.S. Cl. ..... 156/65; 156/293; 182/46; 182/215; 182/217; 182/228

[58] Field of Search ..... 156/65, 293, 294; 182/46, 194, 215, 217, 220, 228; 248/210

[56] References Cited

U.S. PATENT DOCUMENTS

| | | | |
|---|---|---|---|
| 3,039,186 | 6/1962 | Stoyer et al. | 182/228 X |
| 3,208,554 | 9/1965 | Arnold | 182/46 |
| 3,225,862 | 12/1965 | Fink | 182/228 X |
| 3,318,413 | 5/1967 | Werner et al. | 182/46 |
| 3,328,223 | 6/1967 | Fink | 264/261 X |
| 3,502,173 | 3/1970 | Arnold | 182/228 |
| 3,528,525 | 9/1970 | Lindesmith et al. | 182/228 |
| 3,566,992 | 3/1971 | Berger | 182/228 |

FOREIGN PATENT DOCUMENTS

| | | | |
|---|---|---|---|
| 887510 | 12/1971 | Canada | 182/46 |
| 2457005 | 6/1976 | Fed. Rep. of Germany | 182/46 |

*Primary Examiner*—John T. Goolkasian
*Assistant Examiner*—Robert A. Dawson

[57] ABSTRACT

Extension ladders constructed of pultruded fibreglass reinforced plastic for use in an high voltage electrical environment are improved when they do not have any metal components within the field of the induced electrical currents and to achieve the junction between the fibreglass reinforced plastic rungs requires separate molded fibreglass reinforced plastic external sleeves so adhesively bonded to the stiles and the pultruded hollow rungs to make the junction and also such sleeves are not to have any projections outside the outer boundaries of the stiles.

4 Claims, 5 Drawing Figures

FIXING OF ENDS OF WOOD OR REINFORCED PLASTIC RUNGS INTO PULTRUDED FIBREGLASS REINFORCED PLASTIC EXTENSION LADDER STILES WITHOUT THE USE OF METAL

This is a continuation of application Ser. No. 911,900, filed June 2, 1978 and now abandoned.

PRIOR ART:

Moulded, as distinct from pultruded, fibreglass reinforced stiles have integral moulded-on bosses with holes for rungs through the full depth of the ladder stiles and the fibreglass reinforced hollow plastic rungs are adhesively fixed into the moulded bosses of the stiles and such bosses have connection only to the web of the stile section and are clear of the inside of the outer flanges of the stile sections and thus do not offer support to the flanges. Three methods have been used to fix hollow pultruded fiberglass reinforced plastic rungs to hollow rectangular pultruded fibreglass reinforced plastic ladder stiles each with flat sides on the depth of the stile which means that in each case although the rungs have passed into or through the hollow rectangular stile there is either (a) a reinforced plastic flanged outer sleeve bonded to the inner flat face of hollow stile into which ends of the hollow fibreglass reinforced plastic rungs are bonded; (b) similarly, a flanged plug is bonded to the outer face of the flat hollow stile and the plug is bonded internally in the hollow rung; (c) a stepped plug is fixed internally in the end of the hollow rung and this is passed through the rectangular stile section and fixed by a screw which could be plastic through a thick washer. In all three cases either the internal flanged boss reduces the tread width of the rung tread or in the other two cases there is a protrusion external to the outer flat face of the rectangular hollow stile and this is a hinderance to sliding on side for racking as contrast to a flush-sided stile.

BRIEF SUMMARY OF INVENTION

With this invention the hollow fibreglass round reinforced rung or solid round wood rung is rigidly bonded inside two outer moulded separate glass reinforced sleeves which are integral with square shaped flanges which fit flush with the outside or inside of either of two types of stile sections (a) a hollow rectangular fibreglass reinforced stile with recesses on both the outer and inner deep faces of the stiles or (b) a joist-like solid section in which similar square sided flanges with sleeves fit over the rung and give firm support to the outer flange of the stile when bonded into the section and seal the outer face of the stile because the outside moulding is not sleeved for full depth in either application.

DESCRIPTION

Figure 1:
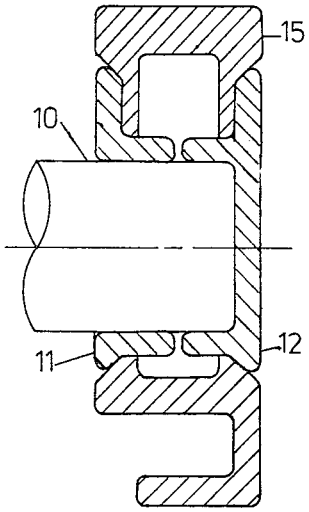
FIG. 1 shows a section of an extension ladder through a right hand hollow rectangular fibreglass reinforced pultruded plastic stile with longitudinal tapered edges of channelled recesses which are identical on both sides and equal in depth.
Figure 3A:
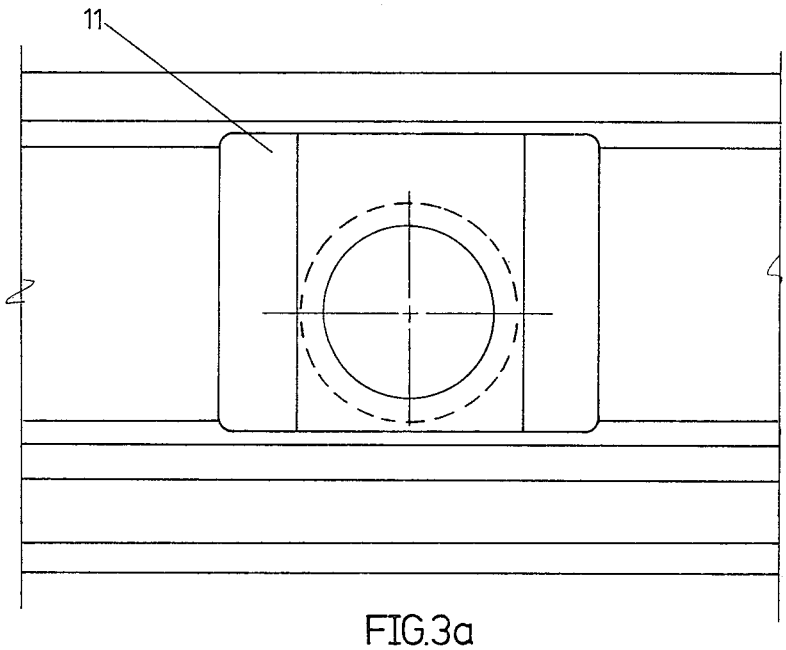
FIGS. 3*a* and 3*b* show partial views as would be seen from the vertical centre line of the assembled ladder stile and rung with approximately square shaped integral flanges with round sockets.
Figure 2:
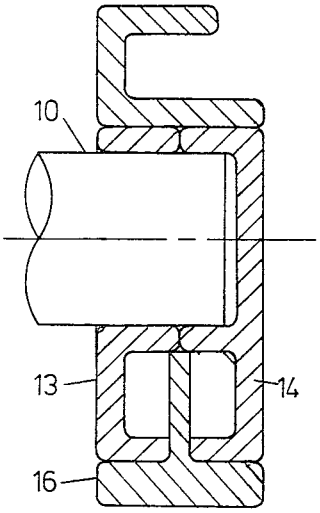
FIG. 2 This is similar to FIG. 1 except that solid central web has been shown in place of the hollow rectangular stile and is an alternative design.
Figure 3B:
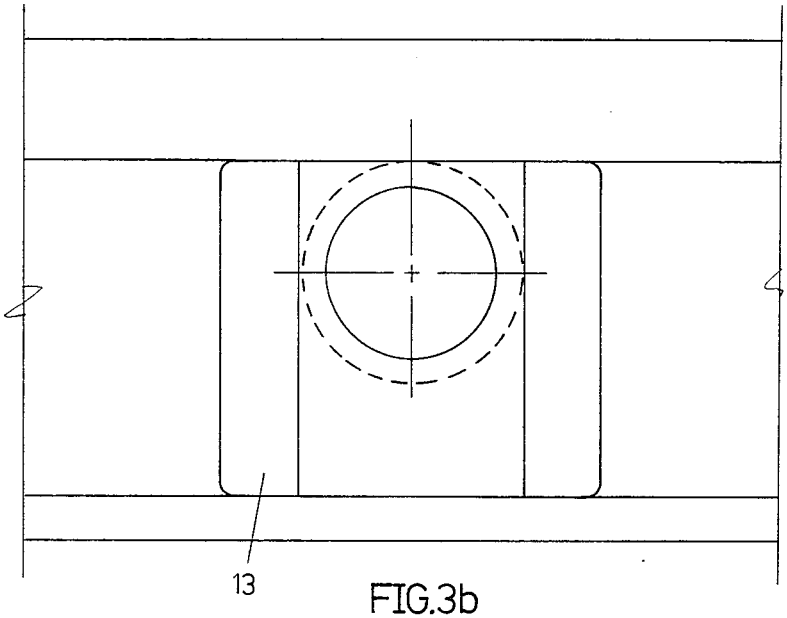
Figure 4:
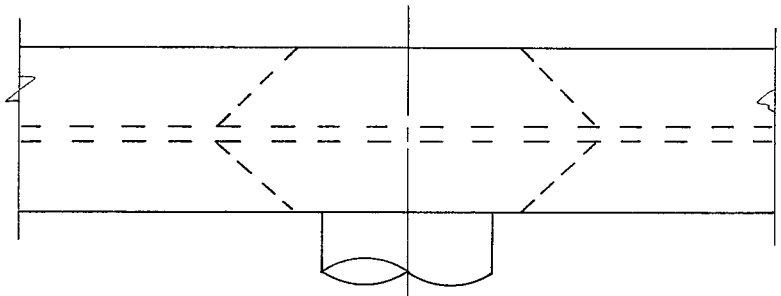
FIG. 4 shows the flush outer and inner faces of the in-line stiles using FIG. 2 sections and would be only slightly modified if FIG. 1 sections were shown.

The combined FIGS. 1, 2, 3*a*, 3*b* and 4 show in art a view of the right hand alternative types of stiles of an extension ladder both of which are specified as of fibreglass reinforced pultruded plastic construction. The round rungs 10 are either solid wood or alternatively hollow fibreglass reinforced plastic pultrusions which are adhesively bonded at each end into a complementary pair of square glass-reinforced combination-flange-supports-and-outer-sleeves parts 11 and 12 or alternatively parts 13 and 14 and in parts 12 and 14 the end of the sleeve is closed. The stiles parts 15 and 16 are ground in the webs or web with round holes to take the outside diameter of the sleeves 11 and 12 or 13 and 14 and two sides of each of the square shaped flanges of 11 and 12 or 13 and 14 are bonded flush into the stiles to support the outer flanges of the stiles and to distribute the resistance to torsion as in a totally solid section of the same outer periphery which is particularly appropriate to part 16 which is the simpler of the alternative sections shown with a solid single central web.

I Claim:

1. A method of rigidly ahesively bonding rungs to pultruded plastic extension ladder stiles without the use of metal comprising adhesively bonding each end of the rungs into holes in a complementary pair of plastic moulded sleeves, said sleeves being capable of fitting into holes in the web or webs of the stiles, said sleeves having shaped flanges of such configuration as to be capable of resisting torsional forces applied from the rung; the outer one of each pair of said shaped flanges being of such a configuration as to completely cover the entire end of the rung without an additional cover and each of the pair of said flanges being of such a size as to not project beyond the inner or outer boundaries defined by the stiles.

2. A method according to claim 1, wherein said flanges contact the outer portions of said stiles in such a manner that the length dimension of the flanges between said outer portions is approximately the same as the depth of the flange at each rung.

3. A method according to claims 1 or 2, wherein the said flanges are square in shape.

4. A method according to claims 1 or 2, wherein the said rungs are either wood or reinforced plastic rungs.

* * * * *